US006554928B2

(12) United States Patent
Astrauskas et al.

(10) Patent No.: US 6,554,928 B2
(45) Date of Patent: Apr. 29, 2003

(54) BINDER FOR A GAS GENERATING MATERIAL

(75) Inventors: Peter J. Astrauskas, Mesa, AZ (US); David D. Ryder, Manassas, VA (US); Michael G. Mangum, Mesa, AZ (US)

(73) Assignee: TRW Inc., Lyndhurst, OH (US)

( * ) Notice: Subject to any disclaimer, the term of this patent is extended or adjusted under 35 U.S.C. 154(b) by 125 days.

(21) Appl. No.: 09/727,199

(22) Filed: Nov. 30, 2000

(65) Prior Publication Data

US 2002/0096234 A1 Jul. 25, 2002

(51) Int. Cl.[7] ..... C06B 45/10
(52) U.S. Cl. ..... 149/19.9; 149/19.91
(58) Field of Search ..... 149/19.9, 19.91

(56) References Cited

U.S. PATENT DOCUMENTS 3,449,179 A * 6/1969 Minekawa et al. ..... 149/19.9
3,501,357 A * 3/1970 Suzuki et al. ..... 149/19.9
4,115,999 A * 9/1978 Diebold ..... 149/19.9
4,168,191 A * 9/1979 Benziger ..... 149/19.91
4,764,586 A 8/1988 Manser et al.
4,978,482 A * 12/1990 Johnson et al. ..... 149/19.9
4,985,094 A * 1/1991 Nahlovsky et al. ..... 149/109.6
4,988,797 A 1/1991 Wardle et al.
5,009,728 A * 4/1991 Chan et al. ..... 149/19.9
5,039,752 A * 8/1991 Storey et al. ..... 149/19.9
5,368,662 A 11/1994 Willer et al.
5,507,891 A * 4/1996 Zeigler ..... 149/19.6
5,663,289 A 9/1997 Archibald et al.
5,847,311 A 12/1998 Ryder

OTHER PUBLICATIONS

Article entitled "Dynamic Mechanical Properties and Impart Strength", J. Heijboer, pp. 3755–3763.
Article entitled "Thermal Properties of Poly (2,6–Dimethyl Phenylene Ether", pp. 561–563.

* cited by examiner

*Primary Examiner*—Edward A. Miller
(74) *Attorney, Agent, or Firm*—Tarolli, Sundheim, Covell & Tummino L.L.P.

(57) ABSTRACT

A gas generating material (16) comprises an oxidizer, a fuel, and a binder composition. The binder composition includes a polystyrene based thermoplastic block copolymer and a thermoplastic modifier. The thermoplastic modifier is miscible with the polystyrene based thermoplastic block copolymer and has a glass transition temperature greater than about 170° C.

20 Claims, 1 Drawing Sheet

BINDER FOR A GAS GENERATING MATERIAL

FIELD OF THE INVENTION

The present invention relates to a binder for a gas generating material. The gas generating material is particularly useful for inflating a vehicle occupant protection device.

BACKGROUND OF THE INVENTION

An inflatable vehicle occupant protection device, such as an air bag, is inflated by gas provided by an inflator. The inflator contains a gas generating material. The inflator further includes an igniter. The igniter is actuated to ignite the gas generating material when the vehicle experiences a collision for which inflation of the air bag is desired. As the gas generating material burns, it generates a volume of inflation gas. The inflation gas is directed into the air bag to inflate the air bag. When the air bag is inflated, it expands into the vehicle occupant compartment and helps to protect the vehicle occupant.

A typical gas generating material for use in an inflator for inflating a vehicle occupant protection device includes a particulate oxidizer and a particulate fuel bound into a solid mass by a binder. A variety of binders are known for binding a particulate oxidizer and a particulate fuel into a solid mass.

The mechanical properties of the binder are critical. The binder must form a solid mass with the particulate oxidizer and the particulate fuel that can satisfactorily ignite and combust over the range of expected operating conditions. The binder must be flexible at temperatures down to about −40° C. and resistant to creep at temperatures up to about 110° C.

SUMMARY OF THE INVENTION

The present invention is a gas generating material that comprises an oxidizer, a fuel, and a binder. The binder includes a polystyrene based thermoplastic block copolymer and a thermoplastic modifier. The thermoplastic modifier is miscible with the polystyrene based thermoplastic block copolymer and has a glass transition temperature greater than about 170° C.

BRIEF DESCRIPTION OF THE DRAWING

Further features of the present invention will become apparent to those skilled in the art to which the present invention relates, from consideration of the following specification, with reference to the accompanying drawing which is a schematic illustration of an apparatus embodying the present invention.

DESCRIPTION OF PREFERRED EMBODIMENTS

Figure 1:
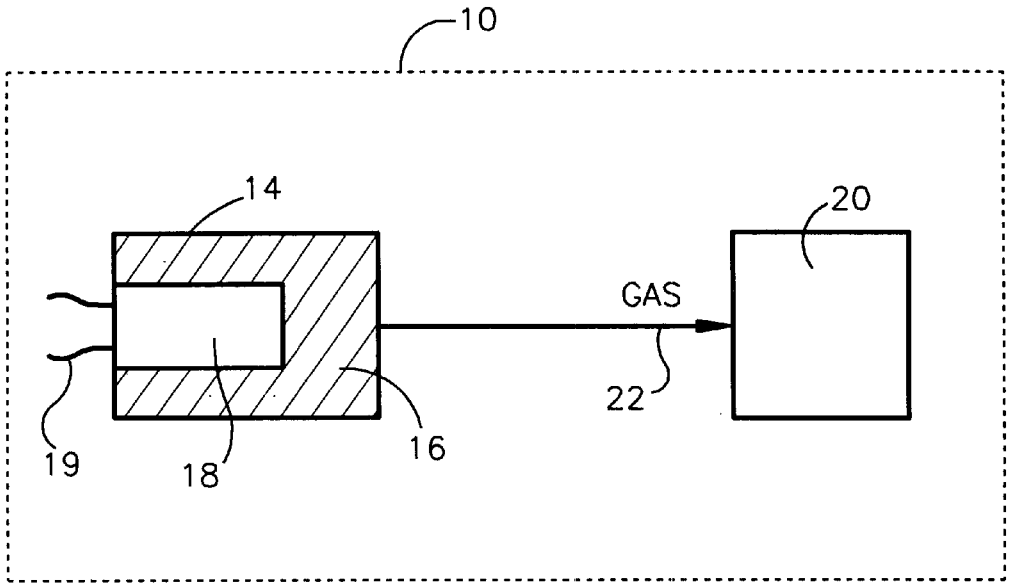

Referring to the FIG. 1, an apparatus 10 embodying the present invention comprises an inflator 14. The inflator 14 contains a generating material 16. The gas generating material 16 is ignited by an igniter 18 operatively associated with the gas generating material 16. Electric leads 19 convey current to the igniter 18 and are part of an electric circuit that includes a sensor (not shown), which is responsive to vehicle deceleration above a predetermined threshold. The apparatus 10 also comprises a vehicle occupant protection device 20. A gas flow means 22 conveys gas, which is generated by combustion of the gas generating material 16, to the vehicle occupant protection device 20.

A preferred vehicle occupant protection device 20 is an air bag that is inflatable to help protect a vehicle occupant in the event of a collision. Other vehicle occupant protection devices that can be used in the present invention are inflatable seat belts, inflatable knee bolsters, inflatable air bags to operate knee bolsters, inflatable head liners, and inflatable side curtains.

In accordance with the present invention, the gas generating material 16 comprises a fuel. The fuel of the gas generating material 16 can be any non-azide nitrogen containing fuel commonly used in a gas generating material for inflating a vehicle occupant protection device. The non-azide nitrogen containing fuel is a material capable of undergoing rapid and substantially complete oxidation upon combustion of the gas generating material. In a preferred embodiment of the present invention, the non-azide nitrogen containing fuel is a nitramine. Preferred nitramines are selected from the group consisting of cyclotrimethylenetrinitramine (RDX), cyclotetramethylenetetranitramine (HMX), and mixtures of cyclotetramethylenetetranitramine and cyclotrimethylenetrinitramine.

The non-azide nitrogen containing fuel can also be other non-azide nitrogen containing fuels typically used in a gas generating material for inflating a vehicle occupant protection device, including: cyanamides such as dicyanamide and salts of cyanamides; tetrazoles such as 5-aminotetrazole and derivatives and salts of tetrazoles; carbonamides such as azo-bis-dicarbonamide and salts of carbonamide; triazoles such as 3-nitro-1,2,4-triazole-5-one (NTO) and salts of triazoles; guanidines such as nitroguanidine (NQ) and salts of guanidine; tetramethyl ammonium nitrate; urea and salts of urea; and mixtures thereof.

The fuel is incorporated in the gas generating material in the form of particles. The average particle size of the fuel is from about 1 $\mu$m to about 100 $\mu$m. Preferably, the average particle size of the fuel is from about 1 $\mu$m to about 20 $\mu$m.

The amount of fuel in the gas generating material 16 is that amount necessary to achieve sustained combustion of the gas generating material. The amount can vary depending upon the particular fuel involved and other reactants. A preferred amount of fuel is in the range of about 10% to about 40% by weight of the gas generating material. More preferably, the amount of fuel in the gas generating material is from about 15% to about 30% by weight of the gas generating material.

The gas generating material 16 further includes an oxidizer. The oxidizer can be any oxidizer commonly used in a gas generating material for inflating a vehicle occupant protection device. A preferred oxidizer is an inorganic salt oxidizer. Examples of inorganic salt oxidizers that can be used in a gas generating material for inflating a vehicle occupant protection device are alkali metal nitrates such as sodium nitrate and potassium nitrate, alkaline earth metal nitrates such as strontium nitrate and barium nitrate, transition metal nitrates such as copper nitrate and basic copper nitrate, alkali metal perchlorates such as sodium perchlorate, potassium perchlorate, and lithium perchlorate, alkaline earth metal perchlorates, alkali metal chlorates such as sodium chlorate, lithium chlorate and potassium chlorate, alkaline earth metal chlorates such as magnesium chlorate and calcium chlorate, ammonium perchlorate, ammonium nitrate, and mixtures thereof.

When ammonium nitrate is used as the oxidizer, the ammonium nitrate is preferably phase stabilized. The phase stabilization of ammonium nitrate is well known. In one method, the ammonium nitrate is doped with a metal cation in an amount that is effective to minimize the volumetric and structural changes associated with phase transitions of pure ammonium nitrate. A preferred phase stabilizer is potassium nitrate. Other useful phase stabilizers include potassium salts such as potassium dichromate, potassium oxalate, and mixtures of potassium dichromate and potassium oxalate. Ammonium nitrate can also be stabilized by doping with copper and zinc ions. Other compounds, modifiers, and methods that are effective to phase stabilize ammonium nitrate are well known and suitable in the present invention.

Ammonium perchlorate, although a good oxidizer, is preferably combined with a non-halogen alkali metal or alkaline earth metal salt. Preferred mixtures of ammonium perchlorate and a non-halogen alkali metal or alkaline earth metal salt are ammonium perchlorate and sodium nitrate, ammonium perchlorate and potassium nitrate, and ammonium perchlorate and lithium carbonate. Ammonium perchlorate produces, upon combustion, hydrogen chloride. Non-halogen alkali metal or alkaline earth metal salts react with hydrogen chloride produced upon combustion to form alkali metal or alkaline earth metal chloride. Preferably, the non-halogen alkali metal or alkaline earth metal salt is present in an amount sufficient to produce a combustion product that is substantially free (i.e., less than 2% by weight of the combustion product) of hydrogen chloride.

The oxidizer is incorporated in the gas generating material in the form of particles. The average particle size of the oxidizer is from about 1 $\mu$m to about 100 $\mu$m. Preferably, the average particle size of the oxidizer is from about 1 $\mu$m to about 20 $\mu$m.

The amount of oxidizer in the gas generating material 16 is that amount necessary to achieve sustained combustion of the gas generating material. The amount of oxidizer necessary to achieve sustained combustion of the gas generating material is about 60% to about 90% by weight of the gas generating material. More preferably the amount of oxidizer in the gas generating material is about 70% to about 85% by weight of the gas generating material.

The gas generating material 16 also includes a binder that is mixed with the fuel and oxidizer to provide an intimate mixture of the fuel and the oxidizer.

The binder composition of the present invention comprises a mixture of polymers. The mixture of polymers has a thermoplastic portion, with a glass transition temperature ($T_g$) of at least about 135° C., and an elastomeric portion, with a glass transition temperature less than about −40° C.

By thermoplastic portion, it is meant the polymers of the binder composition that provide the thermoplastic properties of the binder composition. The thermoplastic properties of the binder composition include the ability of the binder composition to soften when exposed to heat and return to its original condition when cooled, as well as the binder composition's resistance to deformation and creep at temperatures up to about 135° C. The polymers that provide the thermoplastic properties of the binder composition are hard block polymers.

By elastomeric portion of the binder composition, it is meant the polymers of the binder composition that provide the elastomeric properties of the binder composition. The elastomeric properties of the binder composition include the binder composition's ability to resume it original shape after being stressed, as well as the binder composition's flexibility at temperatures down to about −50° C. The polymers that provide the elastomeric properties of the binder composition are soft block polymers.

The binder composition of the present invention is formed by mixing a polystyrene based thermoplastic block copolymer with a thermoplastic modifier. The polystyrene based thermoplastic block copolymer comprises a hard block polymer bound to a soft block polymer. The hard block polymer of the polystyrene based thermoplastic block copolymer is polystyrene. Polystyrene has a glass transition temperature of about 70° C. to about 100° C., a thermal conductivity of 0.116 W/(m*K), and a coefficient of thermal expansion per Kelvin of $2.1\times10^{-4}$.

The soft block polymer of the polystyrene based thermoplastic block copolymer comprises a polyolefin, which has a glass transition temperature of less than about −40° C. Examples of polyolefins, which can be used as a soft block polymer in the present invention, are polyethylene, polypropylene, polybutylene, polybutadiene, polyisoprene, poly(ethylene-ran-butylene), poly(ethylene-ran-propylene), and mixtures thereof. By "ran" in poly(ethylene-ran-butylene) and poly(ethylene-ran-propylene), it is meant a random configuration of the ethylene in relation to the butylene and the ethylene in relation to the propylene, respectively.

The weight ratio of hard block polymer to soft block polymer in the polystyrene based thermoplastic block copolymer of the present invention is about 20/80 to about 40/60. A preferred weight ratio of hard block polymer to soft block polymer is about 30/70.

The polystyrene based thermoplastic block copolymer of the present invention can have various structural configurations. Preferred structural configurations are diblock copolymers, such as $(AB)_n$ block type copolymers, and triblock copolymers, such as ABA block type copolymers, where A is the hard block polymer, B is the soft block polymer, and n is an integer greater than or equal to one.

Preferred diblock copolymers are polystyrene-block-poly (ethylene-ran-butylene), polystyrene-block-poly(ethylene-ran-propylene), polystyrene-block-polybutadiene, and polystyrene-block-polyisoprene.

Preferred triblock copolymers are polystyrene-block-poly (ethylene-ran-butylene)-block-polystyrene, polystyrene-block-poly(ethylene-ran-propylene)-block-polystyrene, polystyrene-block-polybutadiene-block-polystyrene, and polystyrene-block-polyisoprene-block-polystyrene. A more preferred triblock copolymer is polystyrene-block-poly (ethylene-ran-butylene)-block-polystyrene. Polystyrene-block-poly(ethylene-ran-butylene)-block-polystyrene is commercially available from KRATON Polymer, Inc. under the trade name KRATON G1652®. KRATON G1652® has a styrene (hard block) to ethylene-butylene (soft block) weight ratio of about 30/70, a relative molecular weight of about 1, and a Brookfield viscosity of 1350 cps (Neat polymer concentration of 25% in toluene).

The polystyrene based thermoplastic block copolymer of the present invention preferably includes a mixture of a triblock copolymer and a diblock copolymer. A preferred mixture comprises polystyrene-block-poly(ethylene-ran-butylene)-block-polystyrene and polystyrene-block-poly (ethylene-ran-butylene). The polystyrene-block-poly (ethylene-ran-butylene) in this mixture is used as a reinforcing group for the polystyrene end block portions of the triblock copolymer. The polystyrene-block-poly (ethylene-ran-butylene) also acts as internal plasticizer for the binder composition and as a means of reducing the viscosity of the binder composition. A mixture of polystyrene-block-poly(ethylene-ran-butylene)-block-polystyrene and polystyrene-block-poly(ethylene-ran-butylene) is commercially available from KRATON Polymers Inc. under the trade name KRATON G1762®.

KRATON G1762® has a styrene (hard block) to ethylene-butylene (soft block) weight ratio of about 30/70, a relative molecular weight of about 1, and Brookfield viscosity of 200 cps (Neat polymer concentration of 25% in toluene).

The amount of polystyrene based thermoplastic block copolymer in the binder composition of the present invention is about 1% to about 95% by weight of the binder composition. A preferred amount of polystyrene based thermoplastic elastomer in the binder composition is about 30% to about 60% by weight of the binder composition.

The thermoplastic modifier of the binder of the present invention is a hard block polymer that is miscible with the hard block polymer of the polystyrene based thermoplastic block copolymer and that has a glass transition temperature greater than about 170° C. A preferred hard block polymer is a polyether. A polyether, when mixed with the polystyrene based thermoplastic elastomer, does not degrade the flexibility of the polystyrene based thermoplastic block copolymer at temperatures down to about −40° C.

A more preferred hard block polymer is a poly(phenylene ether) such as poly(2,6-dimethyl-1,4-phenylene ether). Poly (2,6-dimethyl-1,4-phenylene ether) is commercially available from GE Plastics Co. as NORYL® Resin. Poly(2,6-dimethyl-1,4-phenylene ether) has a glass transition temperature of about 205° C. to about 210° C., a crystalline melting temperature of about 265° C. to about 267° C., a thermal conductivity of about 0.192 W/(m*K), and a coefficient of thermal expansion per Kelvin of $5.2\times10^{-6}$. Poly (2,6-dimethyl-1,4-phenylene ether) is a hard ductile material at room temperature (i.e., 25° C.) with a heat deflection temperature under load (DTUL) of at least about 179° C. The ductility of poly(2,6-dimethyl-1,4-phenylene ether) is maintained at temperatures down to about −200° C.

Poly(2,6-dimethyl-1,4-phenylene ether) is readily miscible with the polystyrene based thermoplastic block copolymer of the present invention in all proportions. The miscibility of poly(2,6-dimethyl-1,4-phenylene ether) and the polystyrene based thermoplastic block copolymer of the present invention has been demonstrated using optical, mechanical, thermal-optical, electron microscopic, neutron scattering, and small-angle x-ray scattering methods. Calorimetry of blends of the poly(2,6-dimethyl-1,4-phenylene ether) and the polystyrene based thermoplastic block copolymer has shown a negative heat of mixing.

The amount of polyether thermoplastic modifier in the binder composition is about 1% to about 35% by weight of the binder composition. A more preferred amount of polyether thermoplastic modifier is about 4.0% to about 10% by weight of the binder composition.

A second thermoplastic modifier can be mixed with the polystyrene based thermoplastic block copolymer and the polyether thermoplastic modifier to adjust further the glass transition temperature of the thermoplastic portion of the binder composition. The second thermoplastic modifier has a glass transition temperature between the glass transition temperature of the hard block polymer of the polystyrene based thermoplastic block copolymer and the glass transition temperature of polyether thermoplastic modifier. The second thermoplastic modifier is miscible with the hard block polymer of the polystyrene based thermoplastic block copolymer and the polyether thermoplastic modifier.

The second thermoplastic modifier is preferably selected from the group consisting of poly(α-methyl styrene) and poly(styrene-co-α-methyl styrene). Poly(α-methyl styrene) or poly(styrene-co-α-methyl styrene), when mixed with the polystyrene based thermoplastic elastomer, does not degrade the flexibility of the polystyrene based thermoplastic block copolymer at temperatures down to about −40° C.

A more preferred second thermoplastic modifier is poly (α-methyl styrene). Poly(α-methyl styrene) has glass transition temperature of about 160° C. to about 168° C. Poly(α-methyl styrene) is commercially available from Amoco Co. as Endex 160.

The amount of the second thermoplastic modifier in the binder composition is from about 0 to about 60% by weight of the binder composition. More preferably, the amount of second thermoplastic modifier in the binder composition is about 20% to about 50% by weight of the binder composition.

The glass transition temperature of the thermoplastic portion of the binder composition is based on the weighted average of the hard block polymers in the binder composition. As the weight percent of thermoplastic modifier in the binder composition increases, the glass transition temperature of the thermoplastic portion of the binder composition increases. As the weight percent of thermoplastic modifier in the binder composition decreases, the glass transition temperature of thermoplastic portion of the binder composition decreases. The weight percents of the polystyrene based thermoplastic block copolymer and the thermoplastic modifiers in the binder composition of the present invention are adjusted so that the thermoplastic portion of the binder composition has a glass transition temperature of at least about 135° C. More preferably, the weight percents of polystyrene based thermoplastic block copolymer and the thermoplastic modifiers in the binder composition are adjusted to so that the thermoplastic portion of the binder composition has a glass transition temperature of at least about 140° C.

The amount of binder composition in the gas generating material 16 is from about 3% to about 10% by weight of the gas generating material. More preferably, the amount of binder composition in the gas generating material is about 4% to about 6% by weight of the gas generating composition.

The gas generating material of the present invention may also comprise other ingredients commonly added to a gas generating material 16 for providing inflation gas for inflating an inflatable vehicle occupant protection device, such as plasticizers, burn rate modifiers, coolants, and ignition aids, all in relatively small amounts.

Preferably, the components of the gas generating material 16 are present in a weight ratio adjusted to produce, upon combustion, a gas product that is essentially free of carbon monoxide. By essentially free of carbon monoxide, it is meant that the amount of carbon monoxide in the combustion gas product is less than 4% by volume of the gas product.

The gas generating material 16 is prepared by mixing the polystyrene based thermoplastic block copolymer, the polyether thermoplastic modifier, and the second thermoplastic modifier (if utilized) with a non-aqueous polar solvent. Preferred non-aqueous polar solvents are toluene and methylene chloride. The polystyrene based thermoplastic block copolymer, the polyether thermoplastic modifier, and the second thermoplastic modifier (if utilized), are stirred in the non-aqueous polar solvent until a viscous binder solution is formed.

The oxidizer, the fuel, and the other ingredients (if utilized) are added to the binder solution and stirred until the oxidizer and the fuel are uniformly dispersed in the viscous solution and a viscous suspension is formed.

The viscous suspension is spray dried using known spraying drying techniques to produce spheroid particles of gas generating material. The spheroid particles of gas generating material comprise particles of the fuel, the oxidizer, and other ingredients (if utilized) encapsulated by the binder.

The particulate gas generating material is then compacted into the configuration of an aspirin shaped tablet or any other desired configuration.

The tablets so formed are neither brittle at a temperature of about −40° C. nor capable of losing their shape or configuration at a temperature of about 110° C.

by the binder. The spheroid particles had an average particle diameter of about 25 μm. The spheroid particles of gas generating material were then compacted under a compaction pressure of about 11,000 ft-lb (1521 kg-m) into aspirin shaped tablets.

The mechanical properties of the gas generating materials formed using each of the binder compositions of Examples 1–8 were tested using thermomechanical analysis. The results of the thermomechanical analysis are given in Table 2. The mechanical properties of the gas generating materials formed using each of the binder compositions of Examples 1–8 were also tested using compression testing methods. Tests were performed on an Instron test machine. The results of the compression tests are given in Table 3.

TABLE 1

| | Binder glass transition temperature (° C.) (Weighted average) | | Elasto- | Thermo- | | | | |
|---|---|---|---|---|---|---|---|---|
| | Thermo-plastic portion | Elasto-meric portion | meric portion (Wt. %) | plastic portion (Wt. %) | PPO (wt. %) | SEBS (wt. %) | SEB (wt. %) | PMS (wt. %) |
| EX 1 | −50 | 142.7 | 31.85 | 68.15 | 4.5 | 35 | 10.5 | 50 |
| EX 2 | −50 | 139 | 33.95 | 66.05 | 1.5 | 35 | 13.5 | 50 |
| EX 3 | −50 | 146.3 | 29.75 | 70.25 | 7.5 | 35 | 7.5 | 50 |
| EX 4 | −50 | 134.4 | 43.75 | 56.25 | 7.5 | 49 | 13.5 | 30 |
| EX 5 | −50 | 149.7 | 27.65 | 72.35 | 10.5 | 35 | 4.5 | 50 |
| EX 6 | −50 | 152.6 | 25.55 | 74.45 | 13.5 | 35 | 1.5 | 50 |
| EX 7 | −50 | 139 | 37.80 | 62.20 | 6.5 | 42 | 12.0 | 40 |
| EX 8 | −50 | 145.9 | 25.9 | 74.10 | 3.0 | 28 | 9.0 | 60 |

EXAMPLES 1–8

Examples 1–8 illustrate binder compositions and gas generating materials prepared using these binder compositions in accordance with the present invention. The formulations of the binder compositions include poly(2,6-dimethyl-1,4-phenyl ether) (PPE), poly(styrene-block-ethylene-ran-butylene-block-styrene) (SEBS), poly(styrene-block-ethylene-ran-butylene) (SEB), and poly(α-methyl-styrene) (PMS). The formulations of the binder compositions for Examples 1–8 are given Table 1.

A gas generating material was prepared by mixing 4.4 grams of a binder composition with 70 grams of ammonium nitrate phase stabilized with 15%, by weight of the ammonium nitrate, potassium nitrate, 5 grams of potassium perchlorate, 0.5 grams of carbon, 0.1 grams of surfactant, and 50 mL of methylene chloride. The mixture was stirred until a viscous suspension was formed.

The viscous suspension was pumped into a spray dryer (Niro Mino-spray dryer, manufactured by Niro, Inc., Columbia, Md.) and through a fluid nozzle to form spheroid droplets having an average diameter ranging from about 10μ to about 100μ. The droplets were passed through a counter current of hot air, which had a temperature of about 110° C. The hot air caused evaporation of the methylene chloride from the droplets.

Spheroid particles of the gas generating material were formed as a result of the spray drying process. The spheroid particles of gas generating material comprised particles of ammonium nitrate, cyclotetramethylenetetranitrate, potassium perchlorate, carbon black, and surfactant encapsulated

TABLE 2

| | Percent Deformation −40° C. to 90° C. | Coefficient of thermal expansion (%/° C. × $10^3$) |
|---|---|---|
| EX 1 | 0.616 | 6.2 |
| EX 2 | 0.690 | 7.2 |
| EX 3 | 0.843 | 8.1 |
| EX 4 | 0.762 | 6.2 |
| EX 5 | 0.691 | 6.7 |
| EX 6 | 0.887 | 6.9 |
| Ex 7 | 0.744 | 5.1 |
| EX 8 | 0.662 | 6.7 |

TABLE 3

| | 23° C. | | | | | |
|---|---|---|---|---|---|---|
| | Stress psi | Strain % | Modulus, psi | Toughness (stress × strain) | 40° C. Strain % | 107° C. Modulus, psi |
| EX 1 | 7291 | 9.1 | 137103 | 66348 | 9.5 | 61148 |
| EX 2 | 6643 | 8.8 | 134548 | 58458 | 10.3 | 57254 |
| EX 3 | 6689 | 9.1 | 134667 | 60870 | 9.2 | 57259 |
| EX 4 | 6032 | 8.9 | 123430 | 53685 | 9.0 | 60939 |
| EX 5 | 7416 | 7.6 | 180849 | 56362 | 7.0 | 56640 |
| EX 6 | 7792 | 8.8 | 169663 | 68570 | 7.4 | 62314 |
| Ex 7 | 7514 | 9.6 | 164352 | 72134 | 7.5 | 64801 |
| EX 8 | 7367 | 8.2 | 161487 | 60409 | 7.2 | 65713 |

Referring to Table 1, Table 2, and Table 3, the binder composition of Example 1 contains by weight 4.5% poly(2,6-dimethyl-1,4-phenyl ether), 35% poly(styrene-block-ethylene-ran-butylene-block-styrene), 10.5% poly(styrene-block-ethylene-ran-butylene), and 50% poly(α-methyl-styrene). The weight percent of the thermoplastic portion and the elastomeric portion of the binder composition are, respectively, 68.15% and 31.85%. The weighted average glass transition temperature of the thermoplastic portion and the elastomeric portion of the binder composition are, respectively, 142.7° C. and −50° C.

The linear deformation and the coefficient of thermal expansion of the gas generating material prepared using the binder composition of Example 1 indicate that the gas generating material experienced no grain deformation when heated from a temperature of −40° C. to 90° C. Moreover, the modulus at 107° C., the strain at −40° C., and the strain at 23° C. of the gas generating material prepared using the binder of Example 1 indicate that the gas generating material is not susceptible to deformation or creep at higher temperatures, not prone to grain break-up during the ignition of the gas generating material, and elastic without grain failure during temperature cycling.

Example 2 contains by weight 1.5% poly(2,6-dimethyl-1,4-phenyl ether), 35% poly(styrene-block-ethylene-ran-butylene-block-styrene), 13.5% poly(styrene-block-ethylene-ran-butylene), and 50% poly(α-methyl-styrene). The weight percent of the thermoplastic portion and the elastomeric portion of the binder composition are, respectively, 66.05% and 33.95%. The weighted average glass transition temperature of the thermoplastic portion and the elastomeric portion of the binder composition are, respectively, 139° C. and −50° C.

The linear deformation and the coefficient of thermal expansion of the gas generating material prepared using the binder composition of Example 2 indicate that the gas generating material experienced no grain deformation when heated from a temperature of −40° C. to 90° C. Moreover, the modulus at 107° C., the strain at −40° C., and the strain at 23° C. of the gas generating material prepared using the binder of Example 2 indicate that the gas generating material is not susceptible to deformation or creep at higher temperatures, not prone to grain break-up during the ignition of the gas generating material, and elastic without grain failure during temperature cycling.

Example 3 contains by weight 7.5% poly(2,6-dimethyl-1,4-phenyl ether), 35% poly(styrene-block-ethylene-ran-butylene-block-styrene), 7.5% poly(styrene-block-ethylene-ran-butylene), and 50% poly(α-methyl-styrene). The weight percent of the thermoplastic portion and the elastomeric portion of the binder composition are, respectively, 70.25% and 29.75%. The weighted average glass transition temperature of the thermoplastic portion and the elastomeric portion of the binder composition are, respectively, 146.3° C. and −50° C.

The linear deformation and the coefficient of thermal expansion of the gas generating material prepared using the binder composition of Example 3 indicate that the gas generating material experienced no grain deformation when heated from a temperature of −40° C. to 90° C. Moreover, the modulus at 107° C., the strain at −40° C., and the strain at 23° C. of the gas generating material prepared using the binder of Example 3 indicate that the gas generating material is not susceptible to deformation or creep at higher temperatures, not prone to grain break-up during the ignition of the gas generating material, and elastic without grain failure during temperature cycling.

Example 4 contains by weight 7.5% poly(2,6-dimethyl-1,4-phenyl ether), 49% poly(styrene-block-ethylene-ran-butylene-block-styrene), 13.5% poly(styrene-block-ethylene-ran-butylene), and 30% poly(α-methyl-styrene). The weight percent of the thermoplastic portion and the elastomeric portion of the binder composition are, respectively, 56.25% and 43.75%. The weighted average glass transition temperature of the thermoplastic portion and the elastomeric portion of the binder composition are, respectively, 134.4° C. and −50° C.

The linear deformation and the coefficient of thermal expansion of the gas generating material prepared using the binder composition of Example 4 indicate that the gas generating material experienced no grain deformation when heated from a temperature of −40° C. to 90° C. Moreover, the modulus at 107° C., the strain at −40° C., and the strain at 23° C. of the gas generating material prepared using the binder of Example 4 indicate that the gas generating material is not susceptible to deformation or creep at higher temperatures, not prone to grain break-up during the ignition of the gas generating material, and elastic without grain failure during temperature cycling.

Example 5 contains by weight 10.5% poly(2,6-dimethyl-1,4-phenyl ether), 35% poly(styrene-block-ethylene-ran-butylene-block-styrene), 4.5% poly(styrene-block-ethylene-ran-butylene), and 50% poly(α-methyl-styrene). The weight percent of the thermoplastic portion and the elastomeric portion of the binder composition are, respectively, 72.35% and 27.65%. The weighted average glass transition temperature of the thermoplastic portion and the elastomeric portion of the binder composition are, respectively, 149.7° C. and −50° C.

The linear deformation and the coefficient of thermal expansion of the gas generating material prepared using the binder composition of Example 5 indicate that the gas generating material experienced no grain deformation when heated from a temperature of −40° C. to 90° C. Moreover, the modulus at 107° C., the strain at −40° C., and the strain at 23° C. of the gas generating material prepared using the binder of Example 5 indicate that the gas generating material is not susceptible to deformation or creep at higher temperatures, not prone to grain break-up during the ignition of the gas generating material, and elastic without grain failure during temperature cycling.

Example 6 contains by weight 13.5% poly(2,6-dimethyl-1,4-phenyl ether), 35% poly(styrene-block-ethylene-ran-butylene-block-styrene), 1.5% poly(styrene-block-ethylene-ran-butylene), and 50% poly(α-methyl-styrene). The weight percent of the thermoplastic portion and elastomeric portion of the binder composition are, respectively, 74.45% and 25.55%. The weighted average glass transition temperature of the thermoplastic portion and elastomeric portion of the binder composition are, respectively, 152.6° C. and −50° C.

The linear deformation and the coefficient of thermal expansion of the gas generating material prepared using the binder composition of Example 6 indicate that the gas generating material experienced no grain deformation when heated from a temperature of −40° C. to 90° C. Moreover, the modulus at 107° C., the strain at −40° C., and the strain at 23° C. of the gas generating material prepared using the binder of Example 6 indicate that the gas generating material is not susceptible to deformation or creep at higher temperatures, not prone to grain break-up during the ignition of the gas generating material, and elastic without grain failure during temperature cycling.

Example 7 contains by weight 6% poly(2,6-dimethyl-1,4-phenyl ether), 42% poly(styrene-block-ethylene-ran-butylene-block-styrene), 12% poly(styrene-block-ethylene-ran-butylene), and 40% poly(α-methyl-styrene). The weight percent of the thermoplastic portion and elastomeric portion of the binder composition are, respectively, 62.20% and 37.80%. The weighted average glass transition temperature of the thermoplastic portion and elastomeric portion of the binder composition are, respectively, 139° C. and −50° C.

The linear deformation and the coefficient of thermal expansion of the gas generating material prepared using the binder composition of Example 7 indicate that the gas generating material experienced no grain deformation when heated from a temperature of −40° C. to 90° C. Moreover, the modulus at 107° C., the strain at −40° C., and the strain at 23° C. of the gas generating material prepared using the binder of Example 7 indicate that the gas generating material is not susceptible to deformation or creep at higher temperatures, not prone to grain break-up during the ignition of the gas generating material, and elastic without grain failure during temperature cycling.

Example 8 contains by weight 3.0% poly(2,6-dimethyl-1,4-phenyl ether), 28% poly(styrene-block-ethylene-ran-butylene-block-styrene), 9% poly(styrene-block-ethylene-ran-butylene), and 60% poly(α-methyl-styrene). The weight percent of the thermoplastic portion and elastomeric portion of the binder composition are, respectively, 74.1% and 25.9%. The weighted average glass transition temperature of the thermoplastic portion and elastomeric portion of the binder composition are, respectively, 145.9° C. and −50° C.

The linear deformation and the coefficient of thermal expansion of the gas generating material prepared using the binder composition of Example 8 indicate that the gas generating material experienced no grain deformation when heated from a temperature of −40° C. to 90° C. Moreover, the modulus at 107° C., the strain at −40° C., and the strain at 23° C. of the gas generating material prepared using the binder of Example 8 indicate that the gas generating material is not susceptible to deformation or creep at higher temperatures, not prone to grain break-up during the ignition of the gas generating material, and elastic without grain failure during temperature cycling.

From the above description of the invention, those skilled in the art will perceive improvements, changes and modifications. Such improvements, changes and modifications within the skill of the art are intended to be covered by the appended claims.

Having described the invention the following is claimed:

1. A gas generating material comprising:

an oxidizer;

a fuel; and a binder, which includes a polystyrene based thermoplastic block copolymer and a thermoplastic modifier miscible with the polystyrene based thermoplastic block copolymer and having a glass transition temperature greater than about 170° C.

2. The gas generating material of claim 1 wherein the thermoplastic modifier has a glass transition temperature of about 205° C. to about 210° C.

3. The gas generating material of claim 1 wherein the polystyrene based thermoplastic block copolymer does not degrade the flexibility of the polystyrene based thermoplastic elastomer at a temperature of about −40° C.

4. The gas generating material of claim 1 wherein the polystyrene based thermoplastic block copolymer comprises a hard block and a soft block and wherein the hard block includes polystyrene.

5. The gas generating material of claim 4 wherein the soft block is a polyolefin selected from the group consisting of polyethylene, polybutylene, polybutadiene, polyisoprene, poly(ethylene-ran-butylene), and poly(ethylene-ran-propylene).

6. The gas generating material of claim 1 wherein the polystyrene based thermoplastic block copolymer is selected from the group consisting of polystyrene-block-poly(ethylene-ran-butylene)-block-polystyrene, polystyrene-block-poly(ethylene-ran-butylene), polystyrene-block-poly(ethylene-ran-propylene)-block-polystyrene, polystyrene-block-poly(ethylene-ran-propylene), polystyrene-block-polybutadiene-block-polystyrene, polystyrene-block-polybutadiene, polystyrene-block-polyisoprene-block-polystyrene, polystyrene-block-polyisoprene and mixtures thereof.

7. The gas generating material of claim 1 wherein the polystyrene based thermoplastic block copolymer comprises a diblock copolymer, a triblock copolymer, or a mixture of diblock copolymer and a triblock copolymer.

8. The gas generating material of claim 1 wherein the thermoplastic modifier comprises a polyether.

9. The gas generating material of claim 8 wherein the polyether includes poly(phenylene ether).

10. The gas generating material of claim 1 wherein the thermoplastic modifier comprises poly(2,6-dimethyl-1,4-phenylene ether).

11. The gas generating material of claim 1 wherein the binder further includes a second thermoplastic modifier miscible with the polystyrene based thermoplastic block copolymer and the thermoplastic modifier, the second thermoplastic modifier having a glass transition temperature between the glass transition temperature of the polystyrene based thermoplastic block copolymer and the glass transition temperature of the thermoplastic modifier.

12. The gas generating material of claim 11 wherein the second thermoplastic modifier comprises poly(α-methylstyrene).

13. The gas generating material of claim 1 wherein the binder comprises about 1% to about 95% by weight, based on the weight of the binder, of the polystyrene based thermoplastic block copolymer and about 1% to about 35% by weight, based on the weight of the binder, of the thermoplastic modifier.

14. The gas generating material of claim 11 wherein the binder comprises about 1% to about 95% by weight, based on the weight of the binder, of the polystyrene based thermoplastic block copolymer, about 1% to about 35% by weight, based on the weight of the binder, of the thermoplastic modifier, and about 0% to about 60% by weight, based on the weight of the binder, of the second thermoplastic modifier.

15. A gas generating material comprising:

an oxidizer;

a fuel; and a binder, which includes a polystyrene based thermoplastic block copolymer and a thermoplastic modifier miscible with the polystyrene based thermoplastic block copolymer, said thermoplastic modifier being a polyether and having a glass transition temperature greater than about 170° C.

16. The gas generating material of claim 15 wherein the polystyrene based thermoplastic block copolymer is selected from the group consisting of polystyrene-block-poly(ethylene-ran-butylene)-block-polystyrene, polystyrene-block-poly(ethylene-ran-butylene), polystyrene-block-poly (ethylene-ran-propylene)-block-polystyrene, polystyrene-block-poly(ethylene-ran-propylene), polystyrene-block-polybutadiene-block-polystyrene, polystyrene-block-polybutadiene, polystyrene-block-polyisoprene-block-polystyrene, polystyrene-block-polyisoprene and mixtures thereof.

17. The gas generating material of claim 15 wherein said polyether includes a poly(phenylene ether).

18. The gas generating material of claim 15 wherein the binder further includes a second thermoplastic modifier miscible with the polystyrene based thermoplastic block copolymer and the thermoplastic modifier, the second thermoplastic modifier having a glass transition temperature between the glass transition temperature of the polystyrene based thermoplastic block copolymer and the glass transition temperature of the thermoplastic modifier.

19. The gas generating material of claim 18 wherein the second thermoplastic modifier comprises poly(α-methylstyrene).

20. The gas generating material of claim 15, said binder further comprising a second thermoplastic modifier miscible with said polystyrene based thermoplastic block copolymer, said second thermoplastic modifier being selected from the group consisting of poly(α-methyl styrene) and poly (styrene-co-α-methyl styrene).

* * * * *